US005285930A

United States Patent [19]

Nielsen

[11] Patent Number: 5,285,930

[45] Date of Patent: Feb. 15, 1994

[54] METHOD OF DOSING FIBRES

[75] Inventor: Niels H. Nielsen, Odense, Denmark

[73] Assignee: Skako A/S, Faborg, Denmark

[21] Appl. No.: 867,103

[22] PCT Filed: Mar. 27, 1991

[86] PCT No.: PCT/DK91/00093

§ 371 Date: Jul. 2, 1992

§ 102(e) Date: Jul. 2, 1992

[87] PCT Pub. No.: WO91/14551

PCT Pub. Date: Oct. 3, 1991

[30] Foreign Application Priority Data

Mar. 28, 1990 [DK] Denmark ..... 0788/90

[51] Int. Cl.[5] ..... B67D 5/08

[52] U.S. Cl. ..... 222/1; 222/56; 222/161; 177/59; 177/121; 177/122; 177/DIG. 11

[58] Field of Search ..... 222/1, 55, 56, 161, 222/189; 177/59, 121, 122, DIG. 11

[56] References Cited

U.S. PATENT DOCUMENTS

| | | | |
|---|---|---|---|
| 448,853 | 3/1891 | Corey | 222/161 |
| 2,311,373 | 2/1943 | Durning | 222/161 X |
| 2,333,338 | 11/1943 | Rapp | 177/DIG. 11 |
| 2,701,703 | 2/1955 | Evers | 177/121 |
| 2,738,944 | 3/1956 | Lindstaedt et al. | 177/DIG. 11 |
| 2,863,651 | 12/1958 | McBride . | |
| 3,001,672 | 9/1961 | Wahl | 222/55 X |
| 3,117,639 | 1/1964 | Dreeben | 177/DIG. 11 |
| 3,578,094 | 5/1971 | Henry | 222/55 X |
| 3,638,922 | 2/1972 | Guglietti . | |
| 3,696,584 | 10/1972 | Rickard | 177/DIG. 11 |
| 3,944,004 | 7/1974 | Lafitte et al. | 177/121 |
| 3,957,126 | 5/1976 | Hobart | 177/DIG. 11 |

FOREIGN PATENT DOCUMENTS

| | | |
|---|---|---|
| 153450 | 7/1988 | Denmark . |
| 2523905 | 12/1976 | Fed. Rep. of Germany . |
| 2337129 | 2/1979 | Fed. Rep. of Germany . |
| 1288860 | 2/1962 | France . |
| 2401005 | 3/1979 | France . |
| 447080 | 10/1986 | Sweden . |

*Primary Examiner*—Andres Kashnikow
*Assistant Examiner*—Kenneth Bomberg
*Attorney, Agent, or Firm*—Jacobson, Price, Holman & Stern

[57] ABSTRACT

In a method of dosing fibers, such as steel fibers to be mixed in concrete, a supply of fibers (5) is stored in first vibration feeder (2) and is moved from this by means of a second vibration feeder (3). For each dosing operation, a proportioned quantity of fibers (5) is transferred at a stepless rate or a stepwise declining rate from the first to the second vibration feeder (2, 3) while the second vibration feeder (3) stands still. This vibration feeder (3) then transports the transferred fiber quantity further on to the subsequent process while the first vibration feeder (2) stands still. The fibers can hereby be dosed more accurately and uniformly than known before.

10 Claims, 1 Drawing Sheet

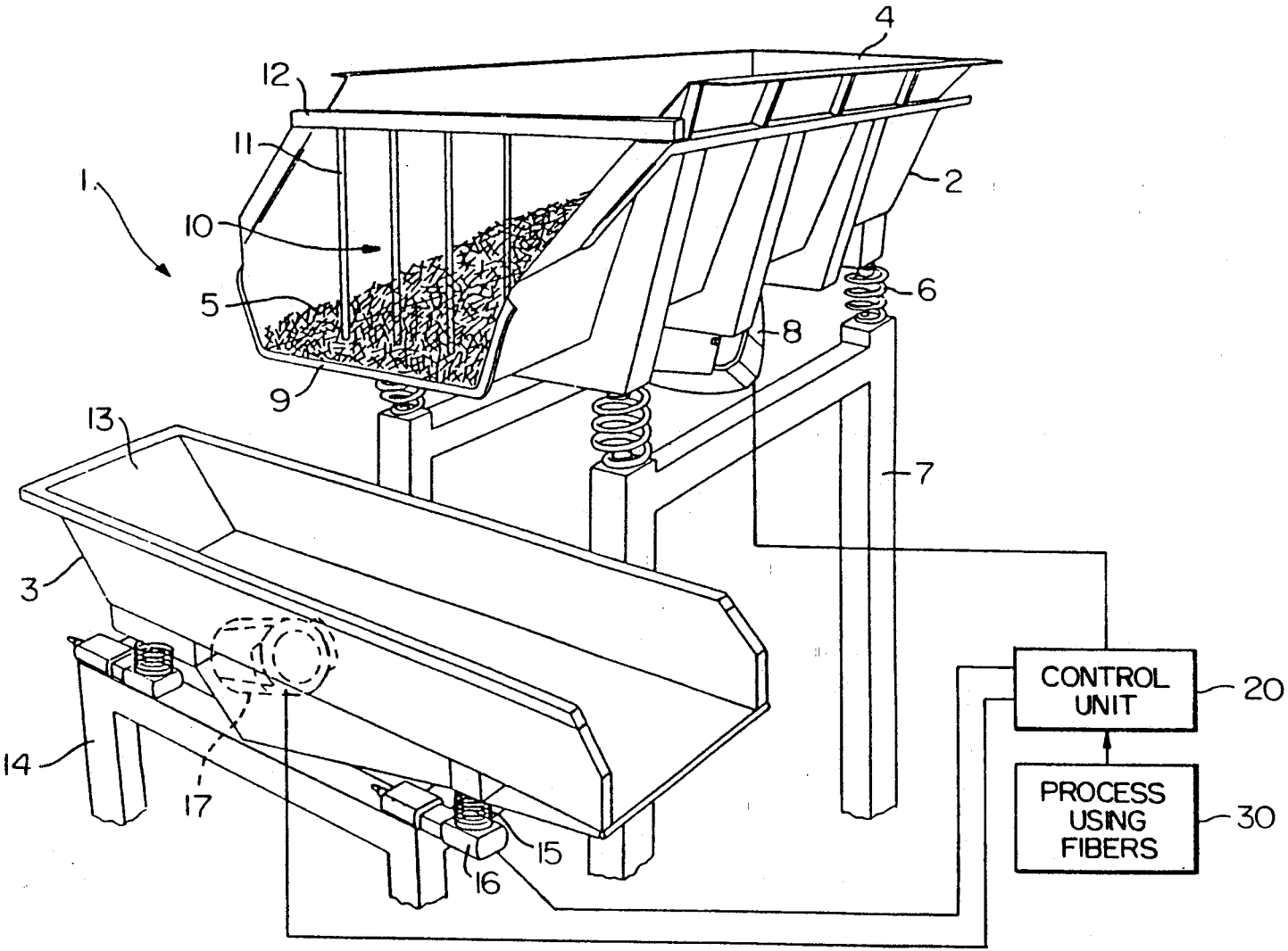
CONTROL UNIT
PROCESS USING FIBERS
20
30
1
2
3
4
5
6
7
8
9
10
11
12
13
14
15
16
17

METHOD OF DOSING FIBRES

FIELD OF THE INVENTION

The invention concerns a method of dosing fibres, such as steel fibres to be mixed in concrete, and where a supply of fibres is stored in a first vibration feeder and is fed from this by means of a second vibration feeder.

BACKGROUND OF THE INVENTION

Fibres of various types are used today to an increasing degree for i.a. reinforcement of cast materials. Thus, reinforced concrete can be produced by adding steel fibres directly during the actual mixing process, which must then be distributed very carefully and uniformly if the finished concrete is to have the required homogenous and isotropic properties. However, this has not been possible to a satisfactory degree by means of the conventional dosing methods which tend to feed the steel fibres in the form of more or less tangled lumps.

The Danish published publication 153 450 B discloses a method and an apparatus for improving steel fibres which are present in bundles or packed lumps, and which, directionally oriented, are to be dosed to an airborne stream of material, such as a sprayed concrete mass. This takes place by tearing the bundles or the lumps apart in preferably a rotating drum with inwardly facing pegs, and gradually discharging the loosened steel fibres during the rotation through variable opening in the drum on an inclined chute, where the fibres are replaced by sliding down the chute under the action of gravity, said chute being constricted in a direction toward the lower end. The fibres now unidirectional are then sucked by a strongly sucking air stream into a pipe stub and further into a transport conduit, in which the unidirectional fibres are fed in an even flow to the mouthpiece in a spray assembly and are sprayed together with the concrete mass mentioned by way of example onto a surface. Tangled fibres can hereby effectively be loosened from each other and be conveyed in an evenly dosed stream with unidirectionally oriented fibres to and be used in e.g. a spray assembly for successive application of fibre-filled concrete on a surface. However, this known method is unsuitable when the fibres are to be used as reinforcement in cast concrete. The reason is that in this case the fibres are to be fed to the concrete mixer evenly and uniformly within a relatively short period of time in a predetermined portion in a loosened, but precisely not unidirectional state.

SUMMARY OF THE INVENTION

The object of the invention is therefore to provide a method of the type stated in the opening paragraph by which it is possible to add a predetermined quantity of fibres to a process more accurately and uniformly than known before.

This is achieved in that the method of the invention is characterized in that a quantity of fibres proportioned for a dosing operation is transferred at a stepless rate or a stepwise declining rate from the first to the second vibration feeder while said feeder stands still, and that the second vibration feeder transports the transferred fibre quantity further on while the first vibration feeder stands still. The tangled fibres are hereby loosened from each other during the vibrations already in the first vibration feeder, which can therefore add to the second vibration feeder an evenly distributed layer of loose fibres which can then rapidly and uniformly be introduced into the mixing process at the desired time.

With a view to accurately proportioning the quantity of fibres to be used in each individual case, the fibres can be transferred according to the invention at an initially relatively great rate and in the end phase at a considerably lower rate.

When the vibrations are generated by electromagnetic vibrators and the second vibration feeder is positioned on electronic weighing cells, dosing may be automatized in an advantageous embodiment of the method of the invention in that the instantaneous amplitude of the vibrations of the first vibration feeder is determined by signals which the weighing cells currently apply to a preprogrammed control unit to which the respective vibrator is connected, and that the vibrator of the second vibration feeder is activated by signal which are applied via the control unit by the process for which the fibres are to be used.

Further, according to the invention, to additionally ensure that tangled lumps do not leave the first vibration feeder, the fibres can be transferred through a net or a grate which is provided on the first vibration feeder at a distance behind its outlet edge substantially transversely to the transport direction of the fibres.

BRIEF DESCRIPTION OF THE DRAWING

The invention will be explained more fully below with reference to the drawing, whose sole FIGURE shows an advantageous embodiment of a dosing system for performing the method of the invention.

DETAILED DESCRIPTION OF THE DRAWING

This system, which is generally designated 1, comprises a first vibration feeder 2 and a second vibration feeder 3.

The first vibration feeder 2 has a trough 4 with such a great capacity that it can simultaneously serve as a storage silo. The trough 4 is open upwardly and may therefore suitably be filled with fibres 5 from e.g. sacks or cartons (not shown). The trough 4 is placed on a first frame 7 via a first set of springs 6 and is vibrated by means of a first electromagnetic vibrator 8. A grate 10 is provided at a distance behind the outlet edge of the trough, said grate consisting of a plurality of bars 11 which are suspended from a transverse rod 12.

The second vibration feeder 3 has a trough 13 which is positioned transversely below the outlet edge 9 on the trough 4 of the vibration feeder 2. The trough 13 stands on a second set of springs 15 which are supported by a second frame 14 via a set of electronic weighing cells 16. A second electromagnetic vibrator 17 serves to vibrate the second vibration feeder 3.

As shown the trough 4 of the first vibration feeder 2 contains a supply of fibres 5. When a quantity of these fibres is to be used for a process, the first vibration feeder 2 is activated via a preprogrammed control unit 20 whereby the vibration feeder 2 initially vibrates fibres into the trough 13 of the vibration feeder 3 at a great rate and finally at a low rate. The entire fibre supply in the first vibration feeder 2 is kept in constant movement during this, so that the tangled structure is loosened completely, no matter whether the trough is filled completely or is almost empty. The bars 11 of the grate 10 have such a mutual distance that the fibres can only pass the grate when they are not tangled. The fibres will therefore drop out through the grate 10 in a loose state and be conveyed further on toward the outlet edge 9 in a relatively thin, loose layer.

During the transfer, the transferred amount of fibres is weighed by means of the electronic weighing cells 16, which currently apply a signal representing the transferred weight to the control unit. When the transfer of the fibres has reached the final phase the control unit, which is programmed accordingly, signals the vibrator 8 to reduce the vibrations so that they correspond to a relatively small transfer rate. When the entire desired quantity has been transferred, the weighing cells 16 then signal the vibrator 8 via the control unit to stop the vibrations, and even if these cannot instantaneously be caused to stop, the transferred quantity will nevertheless be metered with a very great accuracy because of the small transfer rate at the stop time.

During this entire transfer of fibres the second vibration feeder 3 stands still, and the fibres therefore settle as a thin loose layer on the bottom of the trough 13 of this feeder 3. When the subsequent process 30 is to use the fibres, a signal is applied via the control unit to the vibrator 17 of the second vibration feeder 3, said vibrator 17 then vibrating the second vibration feeder 3 so that the metered quantity of fibres is added uniformly and rapidly to the process, which may e.g. consist in mixing concrete with steel fibres. During this part of the operation the first vibration feeder stands still, so that no form of material movement simultaneously takes place between the two vibration feeders.

The system may also comprise several first vibration feeders 2 for their respective types of fibres which may then be added in sequence or blended to the subsequent process.

I claim:

1. A method of dosing fibres to be mixed in concrete, said method comprising:

storing a supply of fibres in a first vibration feeder having a trough for containing fibres and for transporting fibres by the action of a wall of the trough on the fibres, transferring a quantity of fibres proportioned for a dosing operation by vibrations of the first feeder from the first to a second feeder having a trough for containing fibres and for transporting fibres by the action of a wall of the trough on the fibres, while said second vibration feeder stands still, transporting the transferred fibre quantity from said second vibration feeder while the first vibration feeder stands still, and transferring fibres from said second vibration feeder into a concrete mixture being mixed.

2. A method according to claim 1, wherein the fibres are transferred from the first vibration feeder to the second vibration feeder at an initially relatively great rate and substantially at an end phase at a considerable lower relative rate.

3. A method according to claim 1, wherein the vibrations are generated by a first electromagnetic vibrator and the second vibration feeder is positioned on electronic weighing cells for fixing of an instantaneous amplitude of the vibrations of the first vibration feeder by signals which the weighing cells apply to a preprogrammed control unit to which the first vibrator is connected.

4. A method according to claim 1, wherein a vibrator of the second vibration feeder is activated by signals which are applied via a control unit according to a process for which the fibres are to be used.

5. A method according to claim 1, wherein the fibres are transferred through a net or a grate which is positioned on the first vibration feeder substantially transversely to a direction in which the fibres are moved on said first vibration feeder when transferred to the second vibration feeder during the dosing operation.

6. A method according to claim 5, wherein the net or grate is positioned at a distance behind an outlet edge of the first vibration feeder.

7. A method according to claim 1, wherein the vibrations of the first feeder are at a stepless rate.

8. A method according to claim 1, wherein the vibrations of the first feeder are at a stepwise declining rate.

9. A method of dosing fibres to be mixed in concrete, said method comprising:

storing a supply of fibres in a first vibration feeder, transferring a quantity of fibres proportioned for a dosing operation from the first to a second vibration feeder while said second vibration feeder stands still, transporting the transferred fibre quantity from said second vibration feeder while the first vibration feeder stands still, and transferring through a net or a grate positioned on the first vibration feeder substantially transversely to the direction of transport of the fibres.

10. A method of dosing fibres to be mixed in concrete, said method comprising:

storing a supply of fibres in a first vibration feeder, transferring a quantity of fibres proportioned for a dosing operation from the first to a second vibration feeder while said second vibration feeder stands still, transporting the transferred fibre quantity from said second vibration feeder while the first vibration feeder stands still, and positioning a net or a grate at a distance behind an outlet edge of the first vibration feeder.

* * * * *